US006139263A

United States Patent [19]

Klingels

[11] Patent Number: 6,139,263

[45] Date of Patent: Oct. 31, 2000

[54] FLOW MACHINE WITH ROTOR AND STATOR

[76] Inventor: Hermann Klingels, Haimhauer Str. 18, D-85336 Eching, Germany

[21] Appl. No.: 09/252,752

[22] Filed: Feb. 19, 1999

[30] Foreign Application Priority Data

Feb. 20, 1998 [DE] Germany ..... 198 07 247

[51] Int. Cl.[7] ..... F01D 5/20; F01D 9/04

[52] U.S. Cl. ..... 415/173.5; 415/174.2; 415/191; 415/209.4

[58] Field of Search ..... 415/173.5, 174.5, 415/209.2, 209.3, 209.4, 191, 196, 174.2, 230, 231, 9

[56] References Cited

U.S. PATENT DOCUMENTS

| | | | |
|---|---|---|---|
| 2,968,467 | 1/1961 | McGregor . | |
| 3,542,483 | 11/1970 | Gagliardi . | |
| 3,588,267 | 6/1971 | Wilkinson et al. . | |
| 3,843,279 | 10/1974 | Crossley et al. | 415/191 |
| 4,679,400 | 7/1987 | Kelm et al. | 60/722 |
| 4,889,469 | 12/1989 | Wilkinson | 415/191 |

FOREIGN PATENT DOCUMENTS

| | | |
|---|---|---|
| 27 45 130 C2 | 10/1977 | Germany . |
| 33 36 420 A1 | 10/1983 | Germany . |
| 35 40 943 C2 | 11/1985 | Germany . |

*Primary Examiner*—Edward K. Look
*Assistant Examiner*—Rhonda Barton
*Attorney, Agent, or Firm*—Hill and Simpson

[57] ABSTRACT

A flow machine with rotor and stator in axial structure in flow-oriented terms, at least in sections, having moving blades at the rotor and housing-fixed guide vanes, whereby the latter are arranged as at least one guide vane ring with an inner and an outer cover band. The at least one guide vane ring is implemented as self-bearing component part having a closed reinforcement at the inner cover band that reinforces the component part to resist jamming axial deformation, comprises a segmented outer cover band and is positioned in the housing over at least three cover band segments with bearing units that respectively allow radial relative movements. An air guide shell that guides a cooling air stream along the inside of the housing and is provided with openings for the housing-fixed bearing elements of the at least one guide vane ring is arranged between the housing and the outer cover band of the at least one guide vane ring.

11 Claims, 1 Drawing Sheet

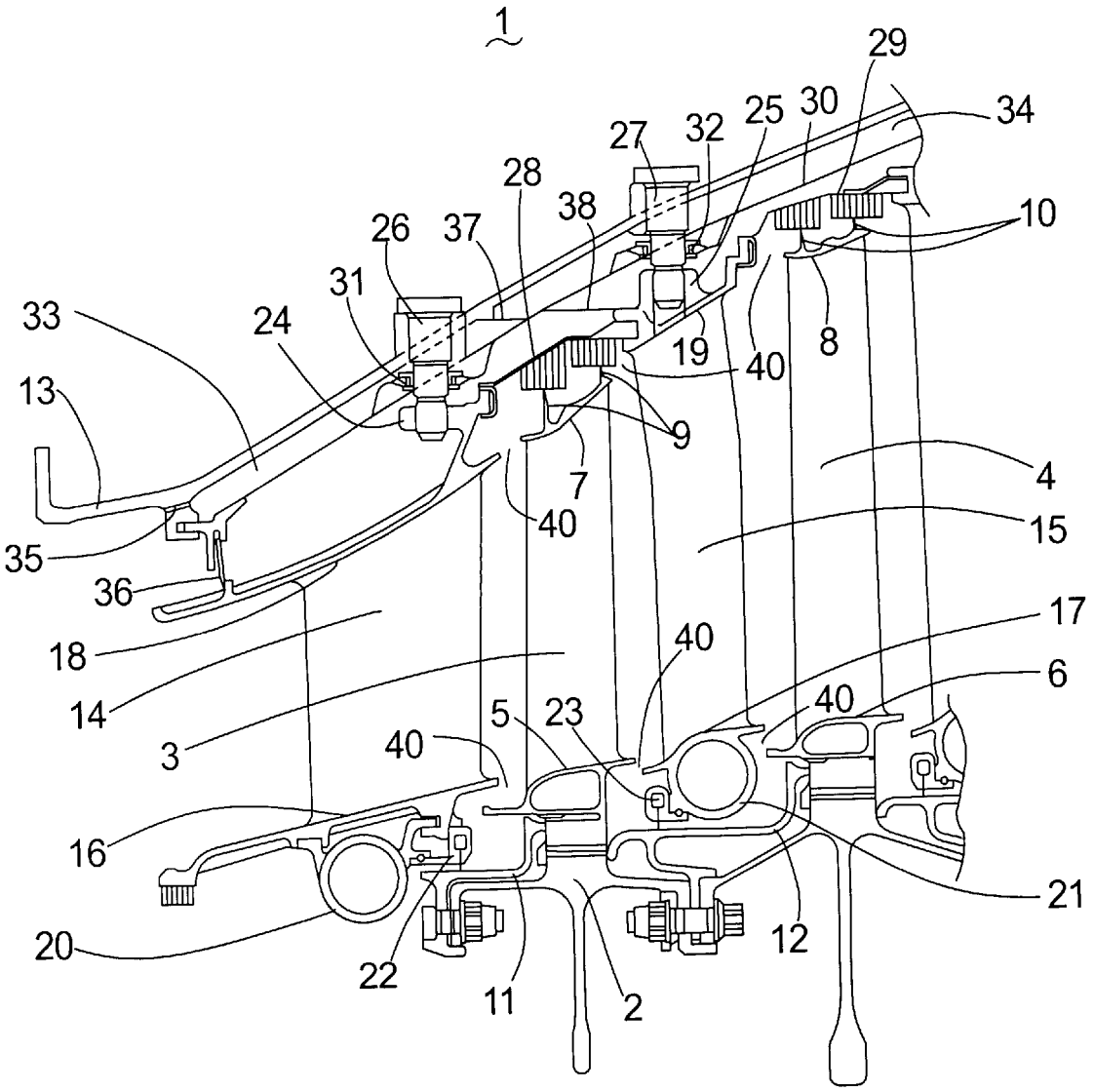
1
29
34
30
25
32
27
28
38
37
26
10
31
33
24
19
40
8
13
9
7
4
40
15
35
36
17
18
40
6
14
5
23
40
3
40
16
21
20
12
22
11
2

FLOW MACHINE WITH ROTOR AND STATOR

BACKGROUND OF THE INVENTION

1. Field of the Invention

The present invention relates to a flow machine with rotor and stator in a single-stage or multi-stage embodiment in flow-oriented terms. More specifically, the present invention relates to a flow machine whose rotor comprises moving blades and whose stator comprises a housing with guide vanes, whereby the guide vanes are arranged as at least one guide vane ring with a radially inner and a radially outer cover band, such as an axial low-pressure turbine.

2. Description of the Prior Art

For example, German Letters Patent 27 45 130 discloses such a flow machine, whereby this patent specifically relates to axial turbines with labyrinth seals. The flow channel of the working agent leads alternately through vane rings and moving blade rings, whereby the static component parts project thereinto radially from the outside and the rotating component parts project thereinto radially from the inside. As FIG. 1 of said patent clearly shows, there are both radially inwardly arranged seals between the rotor and the vane rings (inner air seal) as well as radially outwardly arranged seals between the moving blades and the stator (outer air seal).

Given the axial turbine according to German Letters Patent 27 45 130, the sealing fins (reference numeral 8) of the inner air seal are secured to the rotor (reference numeral 4), so that their dimensions or, respectively, dimensional deviations are dependent on the conditions at the rotor (temperature, speed). By contrast thereto, the appertaining seal coat (reference numeral 7) is secured to the inner cover band (reference numeral 20) of the guide vane segments (reference numerals 1, 5). The guide vane segments are seated at the housing (reference numerals 13, 14), so that the dimensions or, respectively, dimensional deviations of the seal coat are ultimately significantly co-determined by the conditions outside at the housing. The conditions at the rotor, on the one hand, and at the housing, on the other hand, often change neither conformally nor isochronically, so that gap-modifying relative movements between the seal elements (reference numerals 7, 8) derive. The same is true of the outer air seal (reference numerals 11, 12). The specific type of vane ring fastening at the housing is employed thus or comparably given larger engines. Each segment of a vane ring is seated as mechanical unit at housing elements (reference numeral 14) having a hook-shaped longitudinal section that are annularly closed in circumferential direction. At the upstream end of the outer cover band, each guide vane segment comprises an edge bead with channel that embraces the hook-shaped housing element (reference numerals 14, 22) claw-like (see FIG. 3). At the downstream end of the outer cover band of each guide vane segment, a seating unit that is angled-off in longitudinal section is present with a radially outwardly directed seating surface that is pressed against the corresponding hook-shaped housing element during operation as a result of a flow induced tilting moment around the upstream "claw bearing" (see FIG. 1). Due to the hook-shaped housing elements—which can also be referred to as "hook rings"—, high-density heat flows flow to the colder housing, whereby the "hook rings" are increasingly plastically deformed due to creeping, specifically in the region of the "claw bearings". Only a permanent cooling of the "hook rings" can usually alleviate this situation. If present, an active clearance control system (ACC) can be co-utilized, but this must then be in permanent operation.

German Letters Patent 35 40 943 discloses such a clearance control system specifically for a ducted-fan turbine engine. Given this, the secondary air channel extends at least to the end of the turbine region and comprises openings (reference numeral 11) in its inside wall through which secondary air can be designationally blown onto regions of the turbine housing from the outside. Given this simplified ACC system, there is the potential problem that the slight over-pressure of the secondary air stream is inadequate for generating cooling air streams with adequate mass throughput in topically tightly limited housing zones due to correspondingly small flow crosssections. In an active clearance control, compressor air from the booster or, respectively, low-pressure compressor is usually branched off as coolant, conducted in separate channels and designationally blown out via valves.

In smaller gas turbine engines, it is known to implement vane rings as self-bearing, integral component parts with closed cover bands and to center them in the housing. This "monolithic" solution is limited to blade rings with relatively small dimensions for manufacture-oriented as well as strength-oriented reasons (thermal stresses).

German Published Application 33 36 420 discloses a mechanism for protection against an over-turning of a gas turbine rotor given shaft fracture. The mechanism works in such a way that the guide vane segments of at least one vane ring are axially pivoted and brought into contact/engagement with neighboring guide vanes. The mutual mechanical blade friction and destruction quickly and effectively brakes the rotor. The guide vane segments belonging to the mechanism each respectively comprise a drag bearing at the outer cover band segment and have their inside circumference connected with an interlocking, ring-like reinforcing element, so that, together, the segments form a rigid, self-bearing vane ring. Given the embodiment according to FIGS. 2 and 3, the drag bearings (reference numerals 36, 56, 58 and 64) form a spoke centering for the self-stable vane ring, which enables an exact positioning/centering given reduced thermal stresses. The heat transmission from the hot gas zone to the housing (reference numeral 34) is disadvantageous, the bearing elements also being affected by this. The resulting high temperatures and temperature gradients in the component parts of this region can considerably shorten the service life.

U.S. Pat. No. 3,588,267 discloses a vane ring design implemented in plastic wherein the blades are secured to a closed, inner torus and form a self-bearing ring with this. The outer blade tips are implemented without cover band and are glued directly in recesses of a metallic housing, whereby the elasticity of the gluing compensates/absorbs minor relative dislocations. It is obvious that this design is completely unusable for higher temperatures and can at best be employed in the fan or, respectively, low-pressure compressor area.

In view of these known solutions and their disadvantages, objects of the present invention include creating a flow machine with rotor and stator as well as with at least one vane ring comprising a respective outer and an inner cover band that is distinguished in all operating conditions by an optimum clearance retention, i.e. by especially low leakage losses that vary little and can be computationally well-acquired, thus, a high efficiency, as well as by a relatively simple, cost-beneficial and weight-beneficial, durable and maintenance-friendly design without requiring an active clearance control system (ACC) and can be implemented with high powers and dimensions and is also functionally rugged.

SUMMARY OF THE INVENTION

These objects are achieved by a flow machine that comprises a rotor and a stator aligned axially. The rotor comprises a plurality of moving blades. The stator comprises a housing which, in turn, comprises a plurality of guide vane rings. Each guide vane ring comprises a radially inner cover band and a radially outer cover band. The inner cover band of at least one of the guide rings is connected to a reinforcement component to inhibit axial deformation of the guide vane ring. The outer cover band of the guide vane ring comprises a circumference having a plurality of parting seams distributed over the circumference. The housing is connected to at least one bearing element. The outer cover band of the at least one guide vane ring is also connected to a bearing element. The bearing element of the guide vane ring engaging the bearing element of the housing. The housing has an inner surface connected to an air guide shell disposed between the housing and the outer cover band of the at least one guide vane ring. The air guide shell and the inner surface of the housing define an inner chamber for directing a cooling air stream along the inner surface of the housing. The air guide shell further comprises an opening disposed adjacent to the bearing element of the housing for directing at least part of the cooling air stream towards the outer cover band of the at least one guide vane ring.

The invention is thus comprised in the thermal decoupling of housing and guide vanes by a specific embodiment and bearing/centering of at least one vane ring as well as by air-cooling of the housing. The at least one vane ring is implemented as self-bearing component part with a reinforcement at the inner cover band, which stiffens it to resist jamming axial deformation. Proceeding from an approximately planar, radial alignment of the vane axes in the unstressed condition, these are increasingly axially deflected toward the middle of the ring and are thereby also potentially curved due to the static pressure difference preceding/following the vane ring given "zero" excursion at the housing. The vane ring is thus mechanically comparable to a saucer spring whose inner edge (perforated edge) forms the inner cover band and whose outer edge forms the outer cover band. The inner cover band is thereby both axially displaced as well as turned on itself/jammed by the vane-induced moments. The material crosssections of the cover band visible in radial-axial sections are turned to a greater or lesser extent—dependent on stiffness/reinforcement—around imaginary axes respectively perpendicular to the plane of section.

The inventive reinforcement of the inner cover band against said jamming also reduces the axial excursion of the vane axes and, thus, the overall deformation of the vane ring under load. This improves the dimensional stability of the static components of the inner air seal.

Due to the few, small heat bridges/bearing units between outer cover band and housing as well as due to the guidance of the cooling air in this region, a heat transport from the gas channel into the housing is avoided to the farthest-reaching extent, as a result whereof—among other things—slighter temperature gradients also occur in the outer cover band, which, in combination with the segmenting of the outer cover band, reduces the thermal stresses in the guide ring. The air-cooled housing remains at a low temperature level, but contrast whereto the guide ring assumes roughly the hot gas temperature overall.

The at least triple bearing ("spoke centering") of the cover band segments respectively allowing radial movements hardly impedes the thermal expansion/contraction at all and thus also contributes to a minimization of stress. An exact centering in the housing is also achieved.

The inventive combination of vane ring design and bearing as well as cooling air guidance results therein that the deformation behavior of the ring is mainly defined by the conditions/temperatures in the hot gas that also determine the rotor behavior. Since the static components of the inner and outer air seal are carried by the vane rings and behave conformally thereto, a best possible matching of the deformations of the static and rotatory seal components is achieved in view of time curve, size and direction under changing operating conditions (non-stationary operation). The machine can thus be continuously operated with approximately constant, minimal clearances or, respectively, leakage losses and, thus, high efficiency, whereby no premature parts fatigue need be feared, specifically in the guide vane region. The application of brush seals is promoted or, respectively, actually enabled at all by the conformal behavior of the seal carriers (slight clearance modification, slight eccentricity, etc.).

In an embodiment, the reinforcement component is a torous-shaped hollow member.

In an embodiment, the reinforcement component comprises at least two axially spaced rings.

In an embodiment, the reinforcement component is integrally connected to the inner cover band.

In an embodiment, the reinforcement component is connected to the inner cover band in an interlocked fashion and the at least one guide vane ring comprises a plurality of guide vane segments that are connected together by the reinforcement component.

In an embodiment, the reinforcement component is connected to a shaft seal brush. The shaft seal brush engages a rotor seal connected to the rotor.

In an embodiment, the reinforcement component is connected to an inlet coat of a honeycomb seal. The honeycomb seal is connected to the rotor.

In an embodiment, the reinforcement component is connected to an inlet coat of a labyrinth seal. The labyrinth seal is connected to the rotor.

In an embodiment, the bearing element of the housing is a bearing neck and the bearing element of the at least one vane guide ring is a bearing brush. In such an embodiment, the bearing neck is a fixed bearing neck having a crowned contact surface and the bearing brush has a cylindrical contact surface.

In an embodiment, the inner chamber defined by the housing and the air guide shell is divided into a plurality of axially spaced chambers with a pressure drop occurring between any two of the adjacent chambers.

Other objects and advantages of the invention will become apparent upon reading the following detailed description and appended claims, and upon reference to the accompanying drawing.

BRIEF DESCRIPTION OF THE DRAWING

The invention is explained in even greater detail below on the basis of the drawing, wherein:

FIG. 1 is a partial longitudinal sectional view taken through a low-pressure turbine of a turbojet engine.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

The present invention is generally suited for flow machines with rotor and stator, i.e. for compressors and turbines, that are implemented in axial structure, i.e. with predominantly axial flow, at least in sections. Due to thermodynamics and dimensioning, low-pressure turbines of medium through large gas turbine engines might represent preferred applications, for which reason FIG. 1 shows an example from this field.

Of the low-pressure turbine 1, the first two stages and, of these, the relevant elements of the upper half thereof in turn are shown, whereby the turbine/engine axis would proceed horizontally below the illustration. The flow direction of the working gas proceeds from left to right, i.e. first through the guide vane ring 14, then through the zone of the moving blades 3, subsequently through the guide vane ring 15 and through the zone of the moving blades 4, whereby even more stages (guide, moving) could follow. The outer engine jacket is formed by the housing 13 in which the guide vane rings 14, 15 are seated radially centered and axially fixed. Both the moving blades 3, 4 as well as the guide vane rings 14, 15 are implemented with inner and outer cover bands 5 through 8 and 16 through 19, whereby the inner and outer moving blade cover bands respectively comprise parting seams between the blades, so that, among other tings, damaged blades can be individually replaced.

The guide vane rings 14, 15 are implemented as self-bearing component parts, whereby their mechanical stability is mainly achieved in the region of the inner cover bands 16, 17. Reinforcements 20, 21 closed in circumferential direction, i.e. "circumferential" reinforcements 20, 21, are arranged thereat, these also decisively influencing the thermal behavior (dimensional and shape changes) of the guide vane rings 14, 15. Among other things, the gas forces during operation cause a jamming axial deformation of the guide vane rings, i.e. an axial excursion increasing from the outer to the inner cover band with a certain turning of the cover bands on themselves. This "saucer spring-like" deformation can be considerably reduced via the reinforcements at the inner cover bands. For example, the illustrated, torus-like hollow members, axially spaced rings, combinations of hollow and solid profiles, etc., are suitable as reinforcements, whereby the space conditions also play a part. At any rate, the reinforcements should comprise an optimally great geometrical moment of inertia—in axial/radial section—around a radial axis, for example through geometrical center of gravity, which can be achieved by adequate, axially spaced surface parts. The surface parts of the cover band are also to be taken into consideration here. A reinforcing material with a high modulus of elasticity is advantageous. Overall, an optimum of enhanced stiffness should be achieved given optimally low increase in mass. The determination of the stresses and deformations given "jamming" is possible via applicable calculation methods.

The reinforcement 20 is interlocked with the cover band 16, whereby the guide vane ring 14 can be composed of a plurality of segments that are held together via the reinforcement 20. The reinforcement 21, by contrast, is fast with the cover band 17. Here, too, guide vane 15 can be an initial part that is joined by welding or soldering in the region of the reinforcement 21.

The outer cover bands 18, 19, however, should still be segmented in their installed condition, i.e. exhibit a plurality of parting seams at the circumference, in order to minimize thermal stresses.

The centering and fixing of the guide vane rings 14, 15 in the housing 13 ensues via respectively at least three bearing elements each having a housing-fixed bearing neck 26, 27, and a respective bearing bush 24, 25 fixed to the cover band. The contact surfaces of the necks are implemented crowned, the bushes cylindrically, so that small swivel motions in all directions similar to a ball joint are also possible beyond a free radial mobility. All this minimizes constraining forces and, thus, component part stresses, which in turn enhances the service life.

The inner air seal is implemented here—at least mainly—with brush seals, whereby brushes 22, 23 secured in the region of the reinforcements of the guide rings run against rings 11, 12 connected to the rotor 2 that form axial detents for the moving blades 3, 4.

The outer air seal is realized here with labyrinth seals, whereby seal tips 9, 10 like cup points run against honeycomb structures that are applied on honeycomb carriers 28, 29. The honeycomb carriers 28, 29 are in turn seated at the guide vane rings 14, 15 and their deformation behavior is therefore matched thereto.

Within the scope of the invention, an air cooling is provided for the housing and the bearing units of the guide vane rings, but this is not nearly as involved as an active clearance control system. To this end, an air guide shell 30 is arranged at a radial distance at the inside of the housing 13, so that cooling air can flow between this and the housing in longitudinal direction of the engine. The admission of the cooling air, usually branched off from the compressor, ensues via bores 35 into a first chamber 33. In the region of the bearing necks 26 and 27, the air guide shell 30 intentionally comprises gas-permeable openings 31, 32, so that a part of the cooling air can flow along the bearing necks 26, 27 into the region of the outer cover bands 18, 19 of the guide vane rings 14,15, assuming a corresponding pressure gradient (cooling air over-pressure). As a result thereof, the bearing points are cooled and heat flows from the guide vane rings to the housing are minimized. The wall element 37 comprises restrictors (not shown) or, together with appropriate throttle gaps, itself forms a restrictor for the cooling air, so that this enters into the following chamber 34 with reduced pressure. It suffices when the cooling air only respectively exhibits a moderate over-pressure compared to the working gas in the adjacent flow channel. Since the pressure of the working gas axially decreases, it is meaningful to also reduce the cooling air pressure, at least in a few stages, which is achieved here by said chamber structure with restrictors. High over-pressures of the cooling air would also require a high pressure resistance of the air guide shell 30, i.e. greater wall thicknesses and higher weight.

Further wall elements 36, 38 that are intended to prevent working gas sub-streams, i.e. losses, through these passages are arranged between the flow channel of the working gas and the cooling air channel. For cooling reasons, these wall elements 36, 38 are also implemented or, respectively, secured intentionally somewhat gas-permeable.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A flow machine comprising:

a rotor and a stator aligned axially, the rotor comprising a plurality of moving blades, the stator comprising a housing comprising a plurality of guide vane rings, each guide vane ring comprising a radially inner cover band and a radially outer cover band, the inner cover band of at least one of the guide vane ring is connected to a reinforcement component to inhibit axial deformation of the at least one guide vane ring, the outer cover band of the at least one guide vane ring comprises a circumference having a plurality of parting seams distributed over said circumference, the housing being connected to at least one bearing element, the outer cover band of the at least one guide vane ring being connected to a bearing element, the bearing element of the outer cover band of the at least one guide vane ring engaging the bearing element of housing, the housing having an inner surface connected to an air guide shell disposed between the housing and the outer cover band of the at least one guide vane ring, the air guide shell and the inner surface of the housing defining an inner chamber for directing a cooling air stream along the inner surface of the housing, the air guide shell further comprising an opening disposed adjacent to the bearing element of the housing for directing part of the cooling air stream towards the outer cover band of the at least one guide vane ring.

2. The flow machine of claim 1 wherein the reinforcement component is a torus-shaped hollow member.

3. The flow machine of claim 1 wherein the reinforcement comprises at least two axially spaced rings.

4. The flow machine of claim 1 wherein the reinforcement component is integrally connected to the inner cover band.

5. The flow machine of claim 1 wherein the reinforcement component is connected to the inner cover band in an interlocked fashion and the at least one guide vane ring comprises a plurality of guide vane segments that are connected together by the reinforcement component.

6. The flow machine of claim 1 wherein the reinforcement component is connected to a shaft seal brush, the shaft seal brush engaging a rotor seal connected to the rotor.

7. The flow machine of claim 1 further comprising a honeycomb seal that is connected to the rotor.

8. The flow machine of claim 1 further comprising a labyrinth seal that is connected to the rotor.

9. The flow machine of claim 1 wherein the bearing element of the housing is a bearing neck and the bearing element of the outer cover band of the at least one vane guide ring is a bearing brush.

10. The flow machine of claim 9 wherein the bearing neck is a fixed bearing neck having a crowned contact surface and the bearing brush has a cylindrical contact surface.

11. The flow machine of claim 1 wherein the inner chamber is divided into a plurality of axially spaced chambers with a pressure drop occurring between two adjacent chambers.

* * * * *